United States Patent [19]

Matherne

[11] 4,135,605

[45] Jan. 23, 1979

[54] WELDING LADDER WITH FOLDING AND SLIDING RUNGS

[76] Inventor: Michael M. Matherne, Rt. 1-Box 74, Des Allemands, La. 70030

[21] Appl. No.: 820,562

[22] Filed: Aug. 1, 1977

[51] Int. Cl.[2] ..... E06C 1/36; E06C 1/38; E06C 7/08

[52] U.S. Cl. ..... 182/194; 182/106; 182/206; 182/228

[58] Field of Search ..... 182/206, 228, 194, 106, 182/166, 167

[56] References Cited

U.S. PATENT DOCUMENTS

| | | | |
|---|---|---|---|
| 2,975,857 | 3/1961 | Suroff | 182/228 |
| 3,006,434 | 10/1961 | Rich | 182/228 |

*Primary Examiner*—Reinaldo P. Machado

*Attorney, Agent, or Firm*—Calvin J. Laiche

[57] ABSTRACT

The present invention provides a portable light-weight ladder for use in connection with welding metal plates together positioned in an upright or vertical position comprising a main frame portion having extended side rails or stanchions which are rigidly affixed to each other by connecting rungs at each respective end of the side rails as in the manner of a conventional ladder. The side rails are further joined to each other by interconnecting rungs which in turn are provided with a removable portion at approximately the center thereof which portion can be swung or relocated out of position to provide access to an area immediately behind the particular rung, e.g., to gain access to a seam to be welded. One end of the present ladder is provided with an attachment for securing the ladder against a structure upon which the present ladder is to be employed.

4 Claims, 4 Drawing Figures

WELDING LADDER WITH FOLDING AND SLIDING RUNGS

BACKGROUND OF THE INVENTION

The instant invention relates generally to portable work ladders, and more particularly to a relatively small portable ladder that is especially suitable for use by welders for welding a vertical seam on metal structures.

Numerous different types of portable ladders especially designed for use by welders for welding upright or vertical seams on metal structures are available in the prior art today. In most designs of such ladders, it is necessary that the welder be positioned adjacent one of the rails or side stanchions whereby he can gain access to a vertical seam to be welded on a metal structure, for example, a seam on the hull of a ship. By the very nature of their design many of these ladders are relatively unsafe in that they do not provide any form of cage to prevent the welder from falling backwards. In addition, many of these ladders require that the welder be located to either one side or the other of the ladder whereby the ladder itself is placed somewhat off-balance with the net result that quite often the ladder is not employed under stable working conditions. Additionally, besides the welder being uncomfortable in the above regards, the welder is generally welding on the seams slightly from an angle rather than from directly over the seam. In any event, these various types of conventional portable welding ladders offer much to be desired and among the objects of the present invention is to provide a unique portable welding ladder which has the combination of safety and efficient working features and advantages that makes it very attractive and perhaps mandatory from a safety viewpoint.

The above together with other features and advantages of the instant invention will be apparent to one skilled in the art in light of the details of construction and operation of the present welding ladder as shown in the drawing and described in the ensuing detailed disclosure of its preferred embodiment which is particularly pointed out in the appended claims.

DESCRIPTION OF THE DRAWING

For a better understanding of the nature and objects of the invention, reference should be had to the following drawing, taken in conjunction with the detailed description thereof. In the drawing, synonomous reference numerals are employed throughout in the various views to refer to identifal components.

DESCRIPTION OF THE PREFERRED EMBODIMENT

Figure 1:
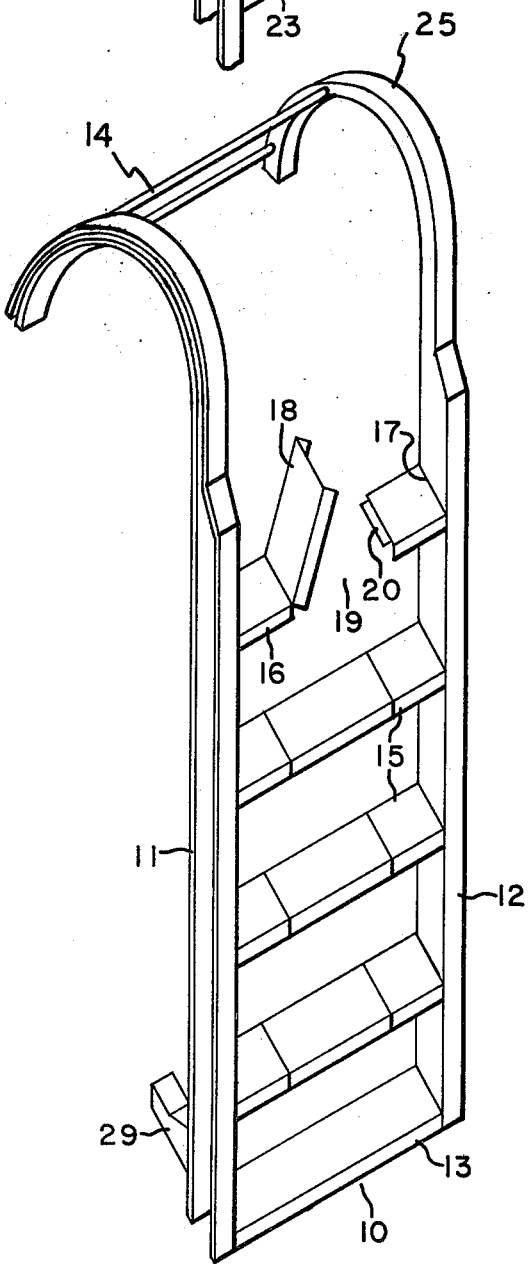
FIG. 1 in the drawing depicts a front elevational isometric view of the present light-weight portable welder's ladder, however, with the safety cage feature removed.

Referring to FIG. 1 of the drawing, the present unique design of portable ladder 10 comprises the elongated side member rails or stanchions 11 which in turn can constitute any suitable design of shape or configuration of an appropriate construction material, however, the side rails 11 and 12 are preferably constructed of aluminum channel members. The members 11 and 12 can be made of any given length as desired, as well as spaced apart any specific width as long as they are sufficiently spaced apart to accomodate the average width of a human being, however, they are preferably spaced wider than a human being to allow full access and the use of various tools before and after a welding operation, e.g., a grinder to dress the welds.

Figure 4:
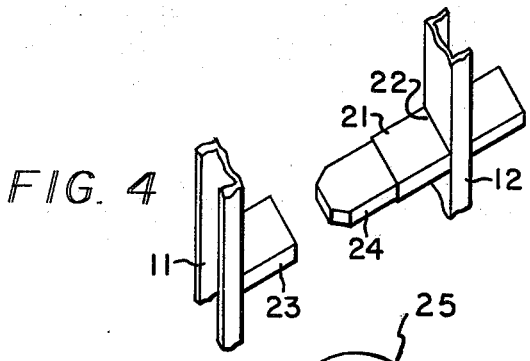
FIG. 4 in the drawing illustrates another preferred embodiment of the specific rung design which can be employed in lieu of the specific design illustrated in FIG. 1 of the drawing.
Figure 3:
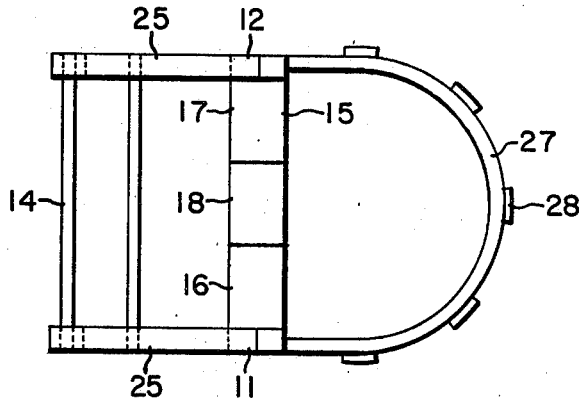
FIG. 3 in the drawing illustrates a plan view of the embodiment of FIG. 2 of the drawing.

The side stanchions 11 and 12 are rigidly affixed to each other by virtue of the lower rung or connecting step member 13 at their bottom end and at their top end by virtue of the solid connecting rods or bars 14. Of course, the bars 14 can be replaced with a single member connecting the top portions of the rails 11 and 12 which is a matter of choice of design. A distinguishing feature of the present design of ladder is embodied in the additional steps or rungs 15 which can comprise any number as desired. In the embodiment of FIG. 4, the ladder 10 comprises the four interior rungs 15 and the bottom rung 13, the four interior rungs 15 being identical in design. The rung 13, as well as the bars 14 and the interior rungs 15 are welded to the rail members 11 and 12, the rungs also being preferably fabricated of a light-weight metal such as aluminum.

The indevidual interior rungs 15 are designed such that an interior portion thereof can be readily relocated or removed in the manners as shown in FIGS. 1 and 4 of the drawing. Referring specifically to FIG. 1 of the drawing, each individual rung or step member 15 further comprises the left hand portion 16 which is rigidly affixed to the side hand rail member 11 and the opposite portion 17 rigidly affixed to the right hand rail member 12. The member 16 and 17 are located essentially on a parallel plane, that is, the various steps or rungs 15 all being essentially parallel to each other and perpendicular to the hand rail members 11 and 12. In other words, they form in essence the design of a conventional ladder in which the various steps 15 are spaced apart more or less on 12 inch centers. Each respective rung 15 further comprises the center removable portion 18 which as shown in FIG. 1 of the drawing, specifically the top most rung, is hinged such that it can be flipped upwards and away out of position to thereby provide the open gap 19. The center portion 18 is held in a horizontal position and prevented from swinging downwards by virtue of the extended clip member 20 which is welded to the under side of the right hand portion 17. Each of the individual rungs 15 in the embodiment as shown in FIG. 1 is designed the same, the lower most three interior rungs being shown in their as closed position.

By virtue of the above structure, a welder can thus readily remove the center portion 18 by swinging it upwards towards the left so as to expose the center gap portion or area 19 such that upon placing the ladder assembly 10 over a seam such that the gap area 19 spans a seam to be welded on a metal structure located behind the ladder, then a welder can readily flip the center portion 18 out of the way and weld downwards while being positioned directly in the middle of the ladder. This unique feature and advantage thus becomes apparent as far as what it offers to the welding art, viz. much greater safety, ease of working, and a considerable improvement in the speed of welding is thus realized. The center portion 18 of a given rung assembly 15 can be hinged to the left hand portion 16 in any conventional manner, such as a conventional hinge assembly welded to the underside of both those members (not shown). Of course, the member 18 could be hinged at the right hand side opposite from that is shown in FIG. 1 of the drawing. The various components 16, 17, and 18 also preferably made of a light-weight material such as aluminum, in fact, it is especially preferred to make the entire ladder out of aluminum or the like light-weight material, however, any type of material of construction can be employed, e.g., steel or the like.

For purposes of illustration only, the arrangement depicted in FIG. 1 of the drawing is shown as including only one solid rung which is the lower most rung 13, however, from a practical viewpoint, a given ladder design would include somewhere between two to four rungs located at the bottom most position as a welder standing upon the lower most rung 13 would probably not attempt to descend or extend welding a seam beneath the height of his chest, but rather, would employ a lower extending ladder or lower the present ladder.

Referring to FIG. 4 of the drawing, the embodiment of the rung assembly 21 illustrated therein performs the same function as that of the rung assembly 15 illustrated in FIG. 1 of the drawing. In that embodiment, the rung assembly 21 further comprises the right hand portion 22 and the left hand portion 23 which in turn are rigidly affixed to the respective side rail members 11 and 12. The portions 21 and 23 comprise a hollow elongated tubular member wherein the sliding member 24 fits, that is, the center portion member 24 bayonets within the portion 22 wherein it can be recessed when gaining access to a welding seam located behind the rung 21, and conversely, is retracted and slid into the open end portion of the left hand portion 23 of the rung assembly 22 when the rung assembly is employed during a non-welding operation, that is, as a conventional ladder. Suitable stops (not shown) are provided on the sliding center portion 24 for preventing it from sliding all of the way out of the right hand portion 22.

Figure 2:
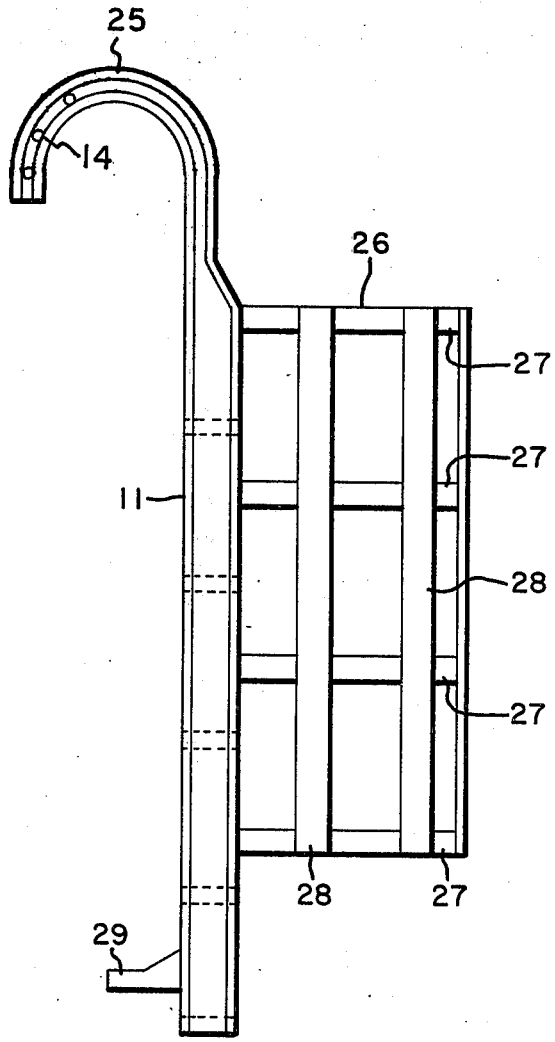
FIG. 2 in the drawing illustrates a side elevational view of the present ladder.

Referring to FIG. 2 of the drawing, the top most portion 25 of each respective hand rail 11 and 12 is provided with some suitable means for attaching the present ladder assembly 10 upon a structure upon which it is being employed, generally a storage tank. For that reason, the top portion 25 of the present welding ladder preferably comprises an arcuate shaped portion fitting over the side rail of the rim of a tank during which type of construction the present ladder is preferably utilized and generally mainly required for use in welding seams toward the top of the tank where the greatest problem is encountered in regard to welding from a safety viewpoint. That is, the seams along the bottom portion of the tank can be more safely handled from the ground level and generally, the upper seams present the greatest problem from a safety viewpoint. For that reason, the present ladder assembly 10 also preferably comprises the cage assembly 26 which is conventional in design, further comprising in turn the horizontal circular struts 27 which are welded at their respective end to each respective hand rail member 11 and 12, being spaced apart at suitable structural distances. The struts 27 are interconnected by the vertically oriented struts 28 so as to define the cage assembly 26 which functions so as to prevent a worker from falling backwards off of the ladder 10. As is well known in the art, generally most workers upon falling from a ladder by losing control and falling backwards, have virtually no chance to grab hold of anything whereby the net result is the fact that they suffer considerable head injuries, as compared to a worker who slips straight down on a ladder whereby he has a chance to grab and hang on an additional rung as he is falling. Thus, among the distinguishing features of the present invention is the fact that the present welding ladder allows the use of a safety cage assembly since the welder need not work to one side or the other of the ladder, but rather, can confine his work space within the side hand rails of the ladder. The net result is a trememdous improvement in safety operating conditions.

The bottom spacer member 29 which is affixed to any suitable portion of the bottom of each respective side hand rail members 11 and 12 is provided for maintaining the ladder assembly 10 a suitable distance away from the structure on which the present ladder has been mounted for use. The spacer member 29 provides a suitable spacing so that the worker can let his foot extend across a respective rung 15 for safety reasons, that is, so that he need not go up and down the ladder with his weight being supported on the front part or ball of his foot under which conditions he would be more apt to slip. Additionally, the spacing member 29 provides a more convenient operating distance between the welder and the particular surface upon which he is working. The length of the spacing member 29 would naturally be determined by the particular working and operating conditions of any given application.

It will be apparent to one skilled in the art that various changes and modifications can be made in the above device, as well as in its mode of use, without departing from the true scope and spirit of the present invention. For example, the present ladder can be produced in different sections and suitably connected together during operations rather than making it in one long extended assembly. For that matter, a telescoping arrangement can be employed as in a conventional ladder. The particular details of the removable center portion of the various rung designs can be varied, for example, in the case of the rung design 15, the center portion 18 can comprise two separate portions, each half of which would be connected to the side member 16 and 17. Various structural details can be elaborated upon so as to improve the structural strength of the present ladder, for example, knee braces can be positioned under the rung side members 16 and 17 so as to strengthen their supporting capability. Additionally, the particular mode or manner of attaching the present ladder assembly 10 to the structure upon which it is to be employed can be varied considerably, that is, the top portion 25 of the hand rails 11 and 12 need not be curved as shown but rather, could be provided with hooks or the like for attaching it to the particular structure upon which the present ladder assembly 10 is being employed.

Other refinements can be made without departing from the intent of the present invention such as providing a gripping material on the rungs 15 so as to insure a sure footing. The spacing member 29 can also be varied in design by making it adjustable so that a worker can readily provide the particular working distance he desires in spacing the ladder assembly 10 from the surface upon which it is being employed.

The various sizes or widths of the portions 16, 17, and 18 of the embodiment of FIG. 1 can vary, however, it is preferred to make the center folding portion 18 of a rung equal in length to that of the rung portion 16 over which it folds so that the portion can fold back flat thereon. Moreover, in the case of the embodiment of FIG. 4, it is preferred to size the portions 21 and 23 such that the sliding rung portion 24 need not have to protrude out of the side of the stantion 12 as shown in FIG. 4.

In light of the above, it can be appreciated by one skilled in the art that many varying and different embodiments may be made within the scopy of my inventive concept as disclosed herein, and accordingly, since many such modifications may be made in the embodiments as disclosed in detail herein, in accordance with the descriptive requirements of the law, it is to be understood that the details of my inventive concept are to be interpreted as illustrative and not in a limited sense. Therefore, what I intend to encompass within the ambit of my invention is that as set forth and particularly pointed out in the appended claims.

What I claim as my invention is:

1. Welding ladder means comprising:

(a) elongated side rail means spaced apart essentially parallel and rigidly affixed to each other at opposite ends; and (b) spaced apart rung means affixed to and oriented essentially perpendicular to said side rail means; said rung means being further defined as having a removable portion across its width which comprising an elongated member having a mid portion which is hindged at one end to the adjoing side portion of said rung means such that it can be swung upwards and back out of the horizontal plane defined by said rung means so as to allow free access across said rung means, said mid portion resting upon the opposite side portion of said run when in a down position.

2. The welding ladder of claim 1 further characterized in that: said opposite side portion of said rung means is provided with an extended portion upon which said mid portion rests so as to retain it in a horizontal position when it is in a down position.

3. Welding ladder means comprising:

(a) elongated side rail means spaced apart essentially parallel and rigidly affixed to each other at opposite ends; and (b) spaced apart rung means affixed to and oriented essentially perpendicular to said side rail means; said rung means being further defined as having a removable portion across its width comprising a slidable mid portion such that it can be slid out of place so as to allow free access across said rung.

4. The welding ladder of claim 3 further characterized in that: said rung means comprises a hollow rectangular tube into which said slidable removable mid-portion bayonets.

* * * * *